US006035788A

United States Patent [19]

Mau et al.

[11] Patent Number: 6,035,788

[45] Date of Patent: Mar. 14, 2000

[54] BOGIE FOR RAIL VEHICLES

[75] Inventors: Rainer Mau, Erkrath; Ulrich Giesen, Krefeld; Leo Geers, Kaarst; Wolfgang Hanneforth, Dresden, all of Germany

[73] Assignee: Duewag Aktiengesellschaft, Krefeld, Germany

[21] Appl. No.: 09/029,665

[22] PCT Filed: Sep. 2, 1996

[86] PCT No.: PCT/DE96/01662

§ 371 Date: Aug. 3, 1998

§ 102(e) Date: Aug. 3, 1998

[87] PCT Pub. No.: WO97/09216

PCT Pub. Date: Mar. 13, 1997

[30] Foreign Application Priority Data

Sep. 8, 1995 [DE] Germany ..... 195 33 263

[51] Int. Cl.[7] ..... B61F 5/00

[52] U.S. Cl. ..... 105/218.1; 105/167; 105/224.05

[58] Field of Search ..... 105/165, 167, 105/168, 218.1, 219, 222, 223, 224.05, 224.1

[56] References Cited

U.S. PATENT DOCUMENTS

| | | | |
|---|---|---|---|
| 4,170,179 | 10/1979 | Vogel | 105/224.05 |
| 4,173,933 | 11/1979 | Kayserling | 105/224.05 |
| 4,735,149 | 4/1988 | Scheffel et al. | 105/218.1 |
| 5,131,332 | 7/1992 | Smith | 105/218.1 |

FOREIGN PATENT DOCUMENTS

| | | | |
|---|---|---|---|
| 559854 | 7/1958 | Canada | 105/218.1 |
| 1294409 | 5/1969 | Germany | 105/218.1 |
| 34 24 531 A1 | 1/1985 | Germany . | |

*Primary Examiner*—Mark T. Le
*Attorney, Agent, or Firm*—Michael J. Striker

[57] ABSTRACT

A bogie for rail vehicles has a frame, two wheel sets connected with the frame and provided with bearings, a steering linkage for achieving radial adjustments of the wheel sets on curved tracks, springs disposed between the frame and the bearings of the wheel sets, the steering linkage being connected to the bearings of the wheel sets below a horizontal central plane of the bearings, laminated steering rods for guiding the bearings on the wheel sets in a longitudinal and a transverse direction, the laminated steering rods acting on the frame about the horizontal central plane, each of the laminated steering rods being resilient and acting parallel to the springs, the steering linkage including a transverse rod, and a transverse bumper arranged between the transverse rod of the steering linkage and the frame.

6 Claims, 2 Drawing Sheets

BOGIE FOR RAIL VEHICLES

BACKGROUND OF THE INVENTION

The invention relates to a bogie for rail vehicles with a frame, two wheel sets and a steering linkage for achieving radial positions of the wheel sets in a rail curve, wherein springs are arranged between the bogie frame and the bearings of the wheel sets, wherein the wheel set bearings are respectively oscillatingly maintained around an axis of rotation above their horizontal central plane in the longitudinal direction of the bogie, and the steering linkage is connected to the wheel set bearings below their horizontal central plane.

A bogie with the above mentioned features is known from DE-OS 34 24 531, see FIGS. 4 and 5. In this bogie the wheel set bearings, held in the manner of a suspended pendulum on the frame, are coupled by means of a so-called Watt linkage (see FIG. 2 in particular) for being adjustable in accordance with the radius of the curve. Additional steering rods (FIG. 13), extending diagonally in respect to each other, are provided for stabilization, which are considered to be disadvantageous because of the large structural outlay.

It is the object of the invention to achieve a tie-in of the wheel sets with the bogie frame which is free of wear to a large extent and permits radial adjustments of the wheel sets in curved rails.

This object is attained in accordance with the invention in that the wheel set bearings are respectively guided in the longitudinal and transverse direction by a laminated steering rod having the axis of rotation located above the horizontal plane, wherein each laminated steering rod is designed to be resilient and acts parallel to the springs.

All transverse forces between the wheel sets and the bogie frame are transferred by the resiliently designed laminated steering rods with the axis of rotation integrated into the primary spring system of the bogie, i.e. the laminated steering rods also take over the transverse guidance of the wheel sets. On a straight track the laminated steering rods, together with the steering linkage, furthermore result in a rigid connection of the wheel sets to the frame in the longitudinal direction, which is important for axial parallelism. Regarding the movement over curved tracks, the laminated steering rod connections of the wheel set bearings are used as pivots which permit radial adjustments of the wheel sets by means of a force balance between the wheel and the rail in relation to the curved rail.

In order to keep the effects of play in the joints of the steering linkage as little as possible, it is provided in accordance with an embodiment of the invention for the laminated steering rod and the steering linkage to be connected with the respective wheel set bearing asymmetrically in relation to the horizontal center plane in such a way, that the lever arm on the steering rod side is smaller than the lever arm on the linkage side.

In view of wear-free pivot movements of the wheel set bearing around the pivot existing on the laminated steering rod, a further embodiment of the invention resides in that the laminated steering rod is connected to the wheel set bearing by a rubber-metal bushing.

In accordance with a next embodiment of the invention it is possible to achieve exact measuring conditions in an assembly-friendly manner in that the laminated steering rod is connected with the bogie frame so that it is adjustable in the longitudinal direction, preferably via corresponding toothed strips.

The invention will be described in more detail in what follows by means of an exemplary embodiment, which is schematically represented in the drawings.

DESCRIPTION OF THE PREFERRED EMBODIMENTS

Figure 1:
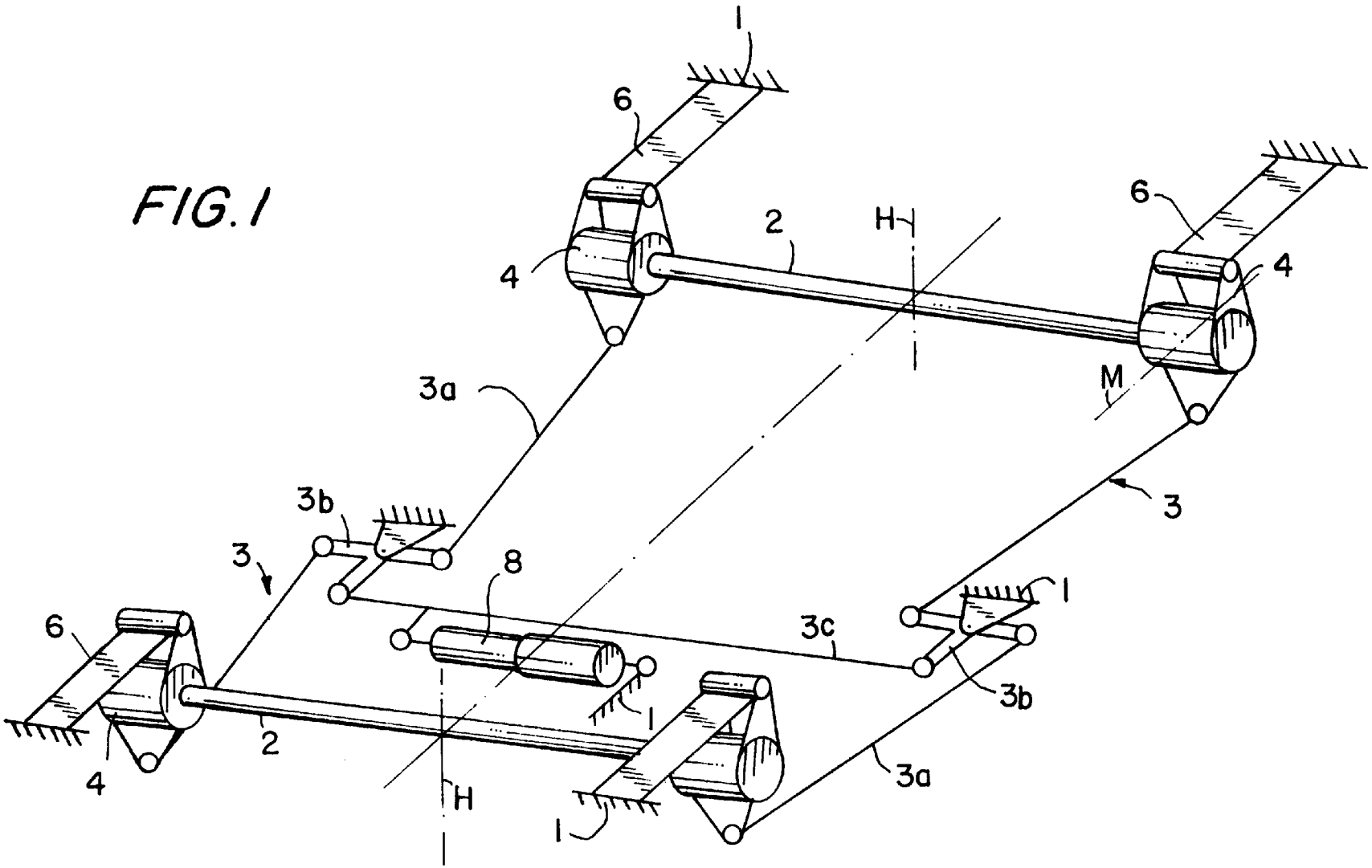
FIG. 1, a bogie in a perspective view.

The bogie has two wheel sets 2 with associated wheel set bearings 4, wherein springs 5 being used as primary springs are arranged between theses bearings 4 and the bogie frame 1. Above the horizontal central plane M a laminated steering rod 6 acts on each wheel set bearing 4 with the interposition of a rubber-metal bushing 7 constituting the axis of rotation 7, and is clamped with its other side on the bogie frame 1. Corresponding toothed strips 1*a* and 6*a* formed in the area of this clamping spot make possible the true-to-measurement adjustment of the wheel sets 2 in a simple way. The wheel set bearings 4 are guided in the longitudinal and transverse direction on the bogie frame 1 by the laminated steering rods 6. The laminated steering rods 6 are embodied to be resilient and, together with their rubber-metal bushing 7 as the axis of rotation, act parallel with the springs 5 in all directions; i.e. they are a component of the primary spring system.

Figure 2:
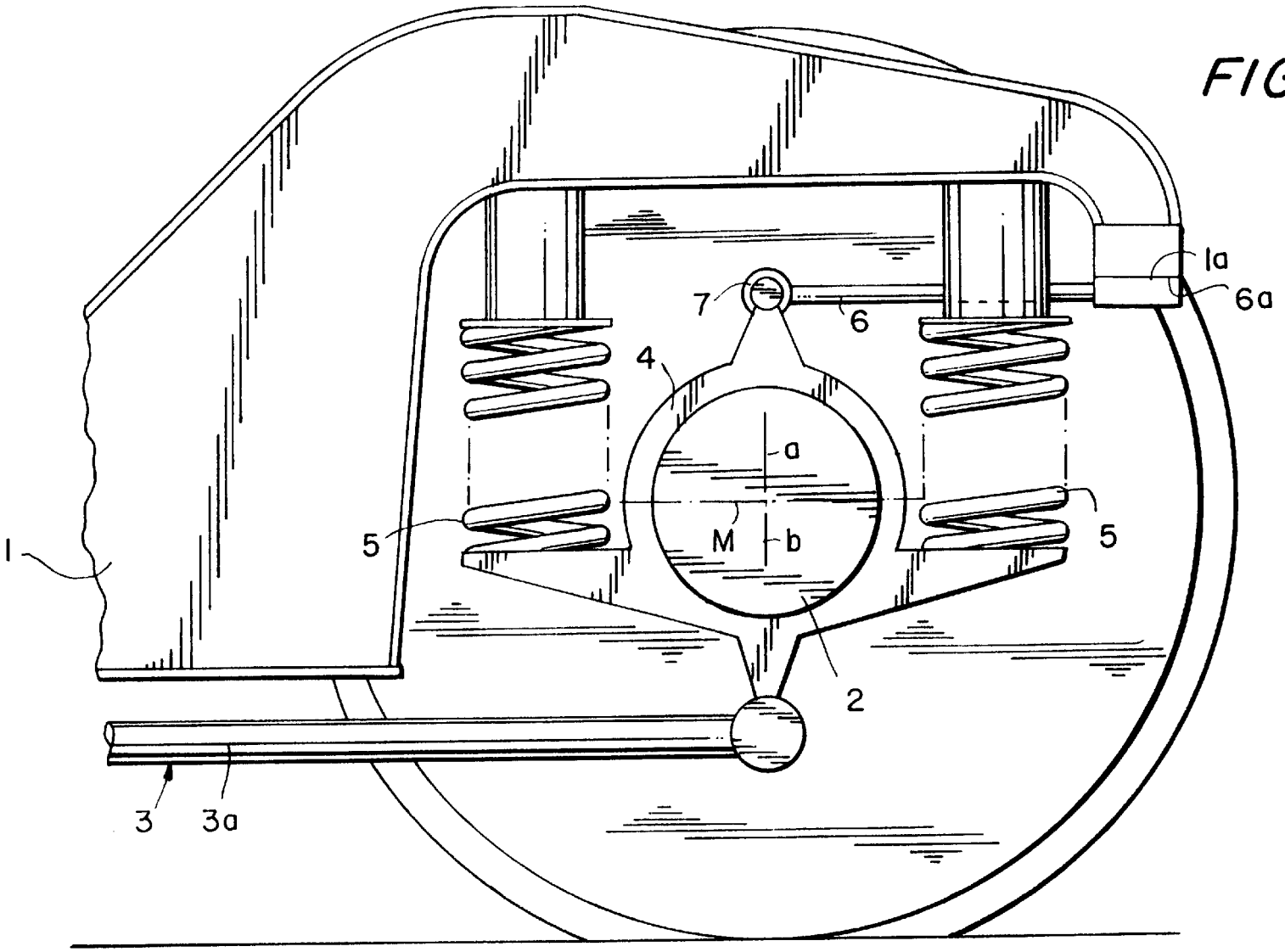
FIG. 2, a partial area of the bogie in a lateral view.

A steering linkage 3 is connected below the horizontal central plane M of the wheel set bearings 4, which consists of steering rods 3*a*, reversing levers 3*b* seated on the bogie frame 1 and a transverse rod 3*c* connecting the reversing levers 3*b*. A transverse damper 8 is arranged between the transverse rod 3*c* of the steering linkage 3 and the bogie frame 1. The entire steering linkage 3 is located in the horizontal plane, so that the installation height in the bogie is very low. In curved tracks, the steering linkage 3 allows the oppositely acting turning of the two wheel sets 2 around their central vertical axis H in the sense of radial adjustments. In the process the wheel set bearings 4 are pivoted around the axis of rotation 7 constituted by the rubber-metal bushing 7 of the laminated steering rods 6. As can be seen in FIG. 2, the laminated steering rods 6 and the steering rods 3*a* of the steering linkage 3 are asymmetrically connected with the wheel set bearing 4 in relation to the horizontal center plane M, wherein the lever arm a on the steering rod side is smaller than the lever arm b on the linkage side. By means of this the effects of play in the joints of the steering linkage 3 on the radial adjustment of the wheel sets 4 is kept small.

The bogie in the arrangement in accordance with FIG. 1 is auto-adjusting, i.e. radial adjustments of the wheel sets 2 result from the force balance between the wheel and the rail in relation to the curved rail. These auto-adjustments are considerably furthered by a profile of the wheel tire, matched to the rail, in the form of a hollow or adaptation profile with a progressively increasing diameter of the running circle in the direction toward the wheel flange.

By a slight alteration of the arrangement represented in FIG. 1 it is possible to achieve adjustments of the wheel sets 2 which are a direct function of the turn-out angle between the bogie and the vehicle chassis. To this end the connection of the transverse rod 3*c* of the steering linkage 3 with a lever at the journal on the vehicle side, for example, is sufficient.

We claim:

1. A bogie for rail vehicles, comprising a frame; two wheel sets connected with said frame and provided with bearings; a steering linkage for achieving radial adjustments of said wheel sets on curved tracks; springs disposed between said frame and said bearings of said wheel sets, said steering linkage being connected to said bearings of said wheel sets below a horizontal central plane of said bearings; laminated steering rods for guiding said bearings on said wheel sets in a longitudinal and a transverse direction, said laminated steering rods acting on said frame about said horizontal central plane, each of said laminated steering rods being resilient and acting parallel to said springs, said steering linkage including a transverse rod; and a transverse damper connected between said transverse rod of said steering linkage and said frame.

2. A bogie as defined in claim 1, wherein said laminated steering rod and said steering linkage are connected with a respective one of said bearings of said wheel sets asymmetrically in relation to said horizontal central plane.

3. A bogie as defined in claim 1, and further comprising a rubber-metal bushing connecting said laminated steering rod to said bearing of said wheel sets.

4. A bogie as defined in claim 1, wherein said laminated steering rod is connected with said frame adjustably in the longitudinal direction.

5. A bogie as defined in claim 4, and further comprising two strips connecting a respective one of said laminated steering rods with said frame.

6. A bogie as defined in claim 1, wherein said steering linkage has two steering rods and two reversing levers connected with said steering rods, said transverse rod connecting said reversing levers.

* * * * *